United States Patent [19]

Hertzberg et al.

[11] Patent Number: 4,938,112

[45] Date of Patent: Jul. 3, 1990

[54] APPARATUS AND METHOD FOR THE ACCELERATION OF PROJECTILES TO HYPERVELOCITIES

[75] Inventors: Abraham Hertzberg, Bellevue; Adam P. Bruckner, Seattle; David W. Bogdanoff, Bellevue, all of Wash.

[73] Assignee: Washington Research Foundation, Seattle, Wash.

[21] Appl. No.: 946,439

[22] Filed: Dec. 23, 1986

Related U.S. Application Data

[63] Continuation of Ser. No. 623,829, Jun. 22, 1984, abandoned.

[51] Int. Cl.[5] ..... F41F 1/00

[52] U.S. Cl. ..... 89/7; 60/270.1; 89/8

[58] Field of Search ..... 60/723, 270.1; 89/7, 89/8

[56] References Cited

U.S. PATENT DOCUMENTS

| | | | |
|---|---|---|---|
| 2,552,497 | 5/1951 | Roach et al. . | |
| 3,126,789 | 3/1964 | Meyer . | |
| 3,148,587 | 9/1964 | Melhart . | |
| 3,213,802 | 10/1965 | Fod | 104/138.1 |
| 3,253,511 | 5/1966 | Zwicky | 89/8 |
| 3,357,306 | 12/1967 | Boyd et al. . | |
| 3,388,633 | 6/1968 | Kirshner . | |
| 3,411,403 | 11/1968 | Rodenberger . | |
| 3,418,878 | 12/1968 | Stricklin . | |
| 3,613,499 | 9/1968 | Hubbard et al. . | |
| 3,742,640 | 7/1973 | Thomsen | 89/16 |
| 4,003,313 | 1/1977 | Puchalski . | |
| 4,098,194 | 7/1978 | Miller et al. . | |
| 4,170,875 | 10/1979 | Edwards . | |
| 4,244,293 | 1/1981 | Grosswendt et al. . | |
| 4,686,826 | 8/1987 | Koshoffer et al. | 60/261 |

FOREIGN PATENT DOCUMENTS 19654 5/1915 France .

OTHER PUBLICATIONS

Letter dated 2/15/85 by Alan Glasser to Dr. William Gerberding, 2 pages.

"The Electrothermal Ramjet" Wilbur, Mitchell, and Shaw, *J. Spacecraft*, vol. 20, No. 6, Nov.–Dec. 1983, pp. 603–610.

"Exhibit A–Glasser Disclosure", Tube–Accelerated Hypervelocity Projectile, a New Approach the High Muzzle Velocity Guns.

"Exhibit B–Meyerand Disclosure", Technology Demonstration of a Tube–Accelerated Hypervelocity Projectile, Aug. 24, 1982.

*Primary Examiner*—Stephen C. Bentley

*Attorney, Agent, or Firm*—Christensen, O'Connor, Johnson & Kindness

[57] ABSTRACT

A projectile is initially accelerated to a supersonic velocity and then injected into a launch tube filled with a gaseous propellant. The projectile outer surface and launch tube inner surface form a ramjet having a diffuser, a combustion chamber and a nozzle. A catalytic coated flame holder projecting from the projectile ignites the gaseous propellant in the combustion chamber thereby accelerating the projectile in a subsonic combustion mode zone. The projectile then enters an overdriven detonation wave launch tube zone wherein further projectile acceleration is achieved by a formed, controlled overdriven detonation wave capable of igniting the gaseous propellant in the combustion chamber. Ultrahigh velocity projectile accelerations are achieved in a launch tube layered detonation zone having an inner sleeve filled with hydrogen gas. An explosive, which is disposed in the annular zone between the inner sleeve and the launch tube, explodes responsive to an impinging shock wave emanating from the diffuser of the accelerating projectile thereby forcing the inner sleeve inward and imparting an acceleration to the projectile. For applications wherein solid or liquid high explosives are employed, the explosion thereof forces the inner sleeve inward, forming a throat behind the projectile. This throat chokes flow behind, thereby imparting an acceleration to the projectile.

14 Claims, 11 Drawing Sheets

Fig. 3.

PROJECTILE ENTRANCE VELOCITY: 1.0 Km/SEC.
PROJECTILE FINAL VELOCITY: 2.5 Km/SEC.

PROJECTILE AVERAGE DENSITY: 2.7 g/cm³
MAX. GAS PRESSURE/MAX. BARREL STRESS: 0.724

BARREL MATERIAL PROPERTIES:

| MATERIAL | MAX. STRESS (atm) | DENSITY (g/cm³) |
|---|---|---|
| STEEL | 7,000 | 7.8 |
| KEVLAR | 16,000 | 1.44 |

| PROJECTILE MASS (Kg) | PROJECTILE DIAMETER (cm) | BARREL MATERIAL | INITIAL GAS PRESSURE (atm) | MAX. GAS PRESSURE (atm) | PEAK ACCELERATION (g's) | BARREL I.D./O.D. (cm) | BARREL LENGTH (m) | BARREL MASS (METRIC TONS) | MASS OF $H_2/O_2$ (Kg) |
|---|---|---|---|---|---|---|---|---|---|
| 500 | 44.8 | STEEL | 150 | 5,070 | 8,980 | 55.7/139.3 | 40.5 | 404 | 85.6/560 |
| 100 | 26.2 | STEEL | 150 | 5,070 | 15,360 | 32.6/81.5 | 23.7 | 81 | 17.1/112 |
| 25 | 16.5 | STEEL | 150 | 5,070 | 24,390 | 20.5/51.3 | 14.9 | 20 | 4.3/28 |
| 10 | 12.2 | STEEL | 150 | 5,070 | 33,100 | 15.2/37.9 | 11.0 | 8.1 | 1.7/11.2 |
| 500 | 44.8 | KEVLAR | 340 | 11,500 | 20,370 | 55.7/139.3 | 17.9 | 32.9 | 85.6/560 |
| 100 | 26.2 | KEVLAR | 340 | 11,500 | 34,850 | 32.6/81.5 | 10.4 | 6.6 | 17.1/112 |
| 25 | 16.5 | KEVLAR | 340 | 11,500 | 55,320 | 20.5/51.3 | 6.6 | 1.63 | 4.3/28 |
| 10 | 12.2 | KEVLAR | 340 | 11,500 | 75,080 | 15.2/37.9 | 4.9 | 0.66 | 1.7/11.2 |

Fig. 7.

PROJECTILE ENTRANCE VELOCITY: 2.5 Km/SEC.
PROPELLANT: $H_2/O_2$ (VARIABLE CONCENTRATION)
INITIAL GAS PRESSURE: 136 atm
MAXIMUM GAS PRESSURE: 11,450 atm
MAX. GAS PRESSURE/MAX. BARREL STRESS: 0.724
PROJECTILE AVERAGE DENSITY: 2.7 g/cm$^3$

BARREL MATERIAL PROPERTIES:

| MATERIAL | MAX. STRESS (atm) | DENSITY (g/cm$^3$) |
|---|---|---|
| KEVLAR | 16,000 | 1.44 |

| PROJECTILE FINAL VELOCITY Km/SEC. | PROJECTILE MASS (Kg) | PROJECTILE DIAMETER (cm) | PEAK ACCELERATION (g's) | BARREL I.D./O.D. (cm) | BARREL LENGTH (m) | BARREL MASS (METRIC TONS) | MASS OF $H_2/O_2$ (Kg) |
|---|---|---|---|---|---|---|---|
| 4.0 | 500 | 44.8 | 7,320 | 63.3/158.3 | 73 | 174 | 159/1516 |
| 4.0 | 100 | 26.2 | 12,520 | 37/92.6 | 43 | 35 | 32/303 |
| 4.0 | 25 | 16.5 | 19,880 | 23.3/58.3 | 27 | 8.7 | 8/76 |
| 4.0 | 10 | 12.2 | 26,980 | 17.2/43.1 | 20 | 3.5 | 3.2/30 |
| 5.0 | 500 | 44.8 | 7,320 | 63.3/158.3 | 164 | 390 | 439/2088 |
| 5.0 | 100 | 26.2 | 12,520 | 37/92.6 | 96 | 78 | 88/418 |
| 5.0 | 25 | 16.5 | 19,880 | 23.3/58.3 | 60 | 19 | 22/104 |
| 5.0 | 10 | 12.2 | 26,980 | 17.2/43.1 | 45 | 8 | 8.8/42 |

Fig. 8a.
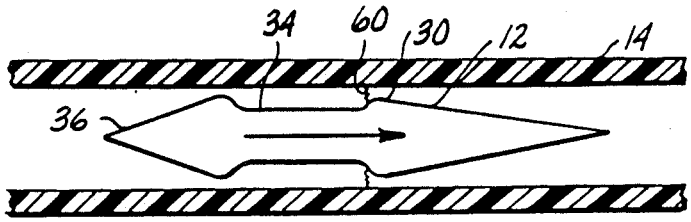
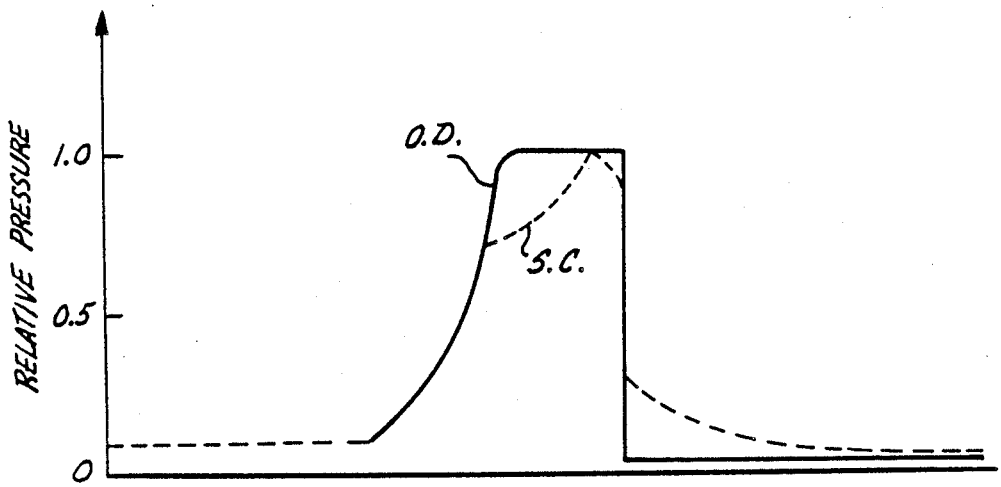
Fig. 8b.

Fig. 10.
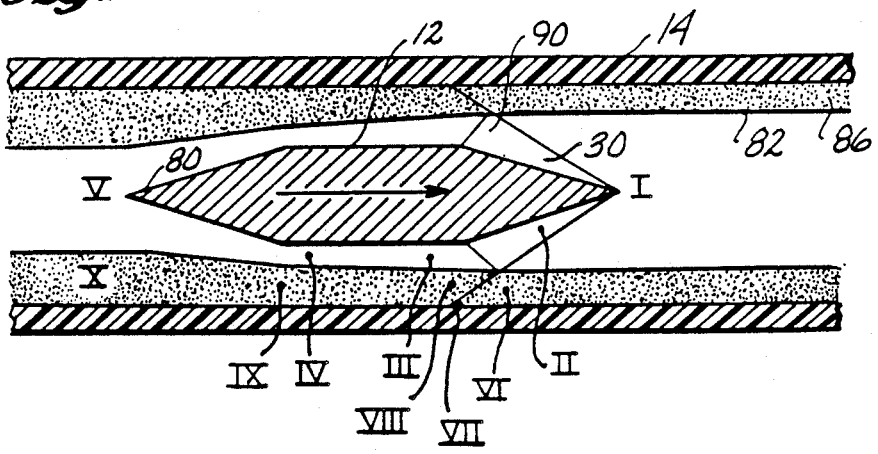
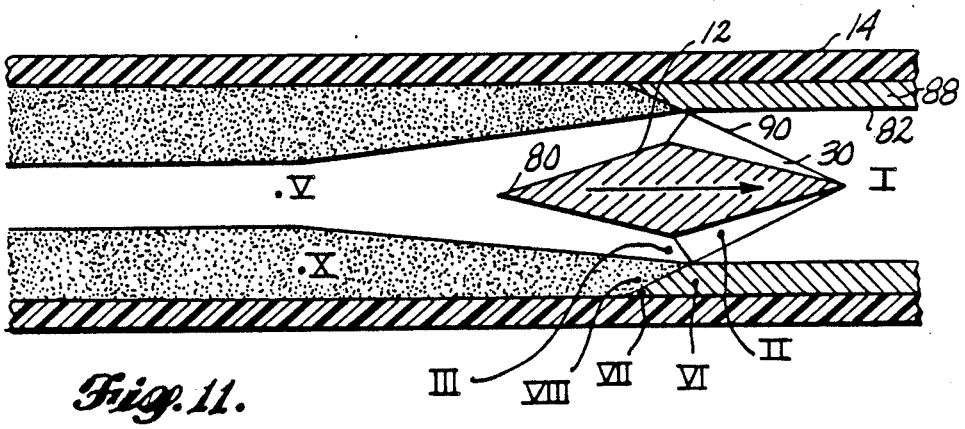
Fig. 11.
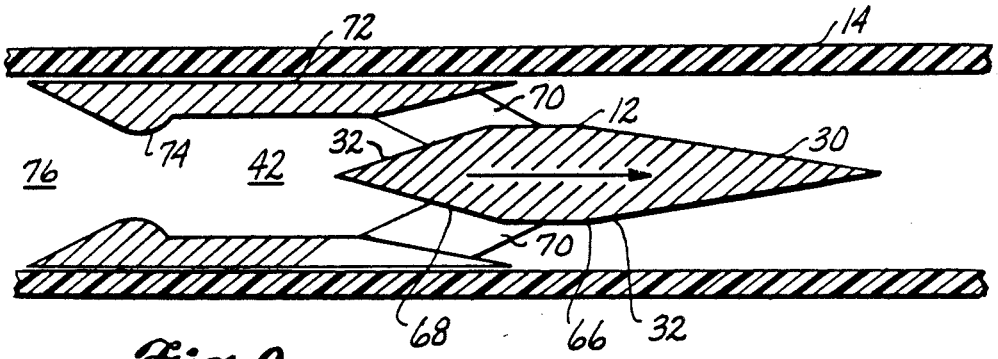
Fig. 9.

Fig. 12.

PRELIMINARY RESULTS OF CALCULATIONS OF LAYERED DETONATION RAM ACCELERATOR CYCLES

PROJECTILE RIDES IN HYDROGEN INITIALLY AT 300°K.
PROJECTILE FORWARD AND REAR CONE HALF-ANGLES ARE 10 DEGREES

| PROJECTILE VELOCITY Km/SEC | EXPLOSIVE --- | INITIAL GAS PRESSURE atm | MAXIMUM GAS PRESSURE* atm | (EFFECTIVE THRUST PRESSURE/ (MAXIMUM GAS PRESSURE *) --- | EFFICIENCY --- |
|---|---|---|---|---|---|
| 8 | $2H_2+O_2$ | 500 | 4640 | 0.651 | 0.035 |
| 12 | HE | 17 | 4680 | .965 | .224 |
| 24 | HE | 4.0 | 6640 | .976 | .268 |

* DOES NOT INCLUDE DETONATION PRESSURE

Fig. 17.
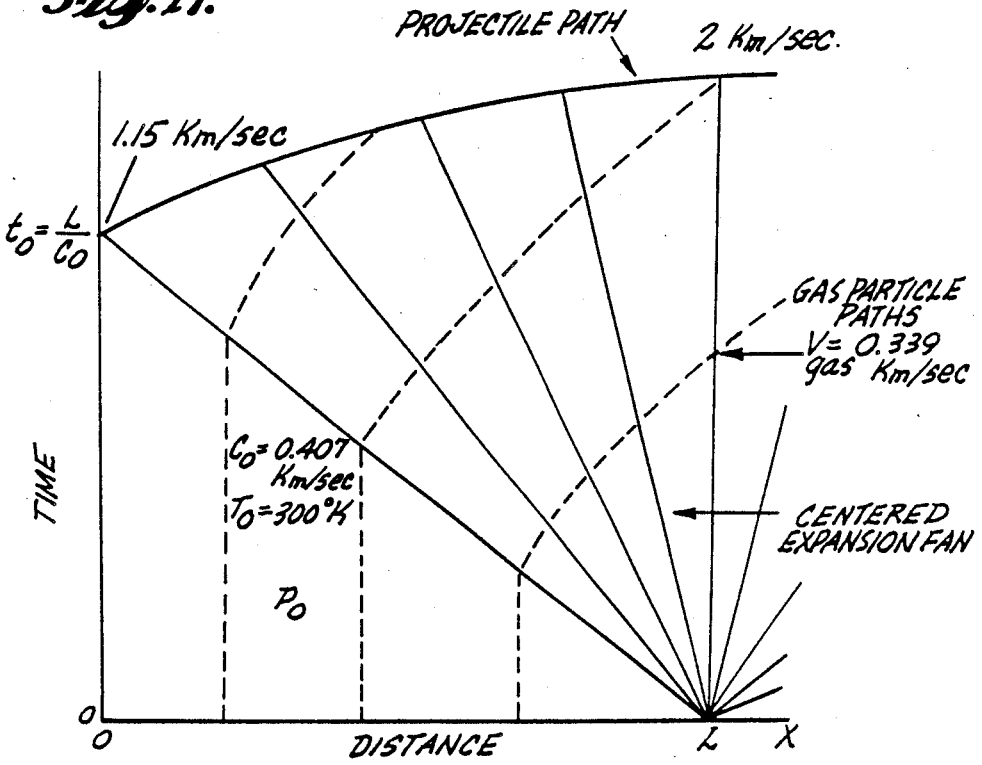
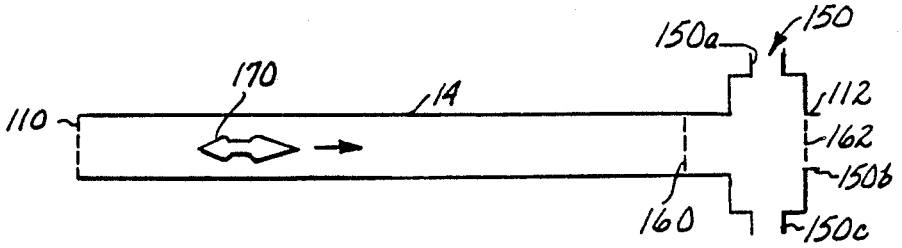
Fig. 16.

APPARATUS AND METHOD FOR THE ACCELERATION OF PROJECTILES TO HYPERVELOCITIES

The invention described and claimed herein was made with U.S. government support, and it is hereby acknowledged that the government has certain rights in the invention.

This is a continuation of the prior application Ser. No. 623,829, filed June 22, 1984, now abandoned, the benefit of the filing dates of which are hereby claimed under 35 USC 120.

BACKGROUND OF THE INVENTION

The present invention pertains to apparatus for, and a method of accelerating objects to high velocities and, more particularly, to an improved apparatus and method for accelerating projectiles to extremely high launch velocities.

Numerous approaches to launching projectiles are known to the prior art. For example, in light gas guns and powder guns a projectile is accelerated by means of a high-pressure gas released behind the projectile within a barrel. A principal limitation with light gas guns and powder guns is that the maximum velocity of the projectile is limited to 1.5–2.0 times the initial acoustic velocity of the driving gas. That is, eventually the projectile is accelerated to a velocity that exceeds the speed of sound in the driving gas, at which point the driving pressure falls off rapidly.

Another known technique for launching a projectile is by means of a rocket propelled vehicle. Rockets are, however, expensive launch systems due to the need to carry substantial amounts of fuel and oxidizer. In addition, the additional mass of the fuel, oxidizer, tanks, and associated structure detracts from the payload of the projectile, thereby substantially adding to the cost per payload delivery.

Other projectile launching systems have been proposed. For example, launching systems employing electric rail guns are presently under development, but problems associated with the storage and switching of the electrical energy levels involved have limited the applications for this technique.

SUMMARY OF THE INVENTION

The present invention, therefore, is directed to improved apparatus for, and a method of accelerating projectiles to high launch velocities.

More specifically, this invention is directed to the aforedescribed improved apparatus and method which incorporates proven scientific principles to accelerate projectiles to hypervelocities.

Briefly, projectile acceleration is accomplished in one or more of three modes, namely, a subsonic combustion mode, an overdriven detonation wave mode, and an ultrahigh velocity mode.

In the subsonic combustion and overdriven detonation wave modes, both a launch tube and a projectile are provided, with the launch tube and projectile being configured such that the projectile flies through the launch tube with the projectile and launch tube forming a ramjet having a diffuser, combustion chamber, and a nozzle. The launch tube is filled with a gaseous propellant, i.e., fuel-oxidizer mixture. An initial accelerator injects the projectile into the launch tube at a predetermined supersonic velocity relative to the gaseous propellant. The gaseous propellant is then ignited by suitable means in the combustion chamber to thereby accelerate the projectile.

In the subsonic combustion mode, ignition of the gaseous propellant is, preferably, produced by a flame holder that projects from the projectile such that the gaseous propellant is ignited by the flame holder in the combustion chamber. The flame holder is, preferably, catalytic coated to promote combustion.

In the overdriven detonation wave mode, the projectile diffuser preferably includes a predeterminedly formed diffuser divergent region extending into the combustion chamber such that upon the projectile being accelerated to a predetermined velocity an overdriven detonation wave capable of igniting the gaseous propellant is produced in the diffuser divergent region. Also, the projectile nozzle preferably is formed such that the overdriven detonation wave is maintained in the diffuser divergent region.

Preferably, the gaseous propellant is a predetermined mixture of hydrogen gas and oxygen gas, although other combustible gases including, but not limited to, methane, ethane, or propane may be used as the fuel gas. Also, to reduce pressure loading on the launch tube, the projectile may include a shroud for containing the high pressure portion of the projectile thermodynamic cycle.

In the ultrahigh velocity mode, provided is a launch tube, a thin inner sleeve disposed within the launch tube defining an annular zone between the inner sleeve and the inner surface of the launch tube and a projectile that is adapted to fly through the launch tube and inner sleeve. The projectile has a provided nose configuration for producing, at a predetermined projectile velocity, a shock wave that extends to the annular zone. An explosive material, which is disposed within the annular zone, responds to the impinging shock wave from the projectile to explode, thereby forcing the inner sleeve inward and forming a throat behind the projectile. This throad chokes the flow behind, thereby imparting an acceleration to the projectile.

Preferably, the inner sleeve may be formed of metal, plastic, carbon composite or other suitable material and is filled with hydrogen gas.

In alternative aspects of the invention, the explosive material in the annular zone is either a mixture of gases such as hydrogen gas and oxygen gas, or a liquid or solid high explosive.

In any of the three accelerating modes, the pressure or composition of the gaseous medium within the launch tube (or inner sleeve) is preferably predeterminedly varied, to thereby control the peak pressure on the accelerating projectile. In one aspect of the invention, the launch tube is divided into predetermined segments, with each segment adapted to be filled with a gaseous medium at a predetermined pressure and exhibiting a predetermined speed of sound such that as the projectile accelerates through successive segments, the peak pressure on the projectile is maintained within a predetermined range by limiting the Mach number range. The segments are defined by thin diaphragms mounted within the launch tube, thereby isolating the gaseous medium in one segment from the gaseous medium in adjoining segments while being penetrable by the accelerating projectile. Alternatively, the launch tube can be filled with a gas which exhibits a smooth variation of composition along the barrel such that the speed of sound increases from the breech to the muzzle in a predetermined manner.

In an alternative aspect of the invention, a rarefaction wave is produced in the gaseous medium, which rarefaction wave is synchronized with the travel of the projectile through the launch tube such that the pressure on the accelerating projectile is maintained within a predetermined range. This rarefaction wave may be produced by venting the gaseous medium to ambient at the muzzle end of the launch tube.

In a further aspect of the invention, the gaseous medium in the launch tube may be preheated at predetermined locations to thereby control the pressure on the accelerating projectile. Both RF arc, and laser heaters are suitable for this controlled heating.

BRIEF DESCRIPTION OF THE DRAWINGS

FIG. 3 is a table setting forth various operating parameters for the subsonic mode projectile acceleration as depicted in FIG. 2;

FIG. 7 is a table setting forth various operating parameters for the overdriven detonation wave mode of projectile acceleration as depicted in FIG. 6;

FIGS. 8A and 8B depict relative pressure on the projectile as it accelerates in either the subsonic combustion mode or the overdriven detonation wave mode;

FIG. 9 is a cross-sectional view illustrating a projectile accelerating down a launch tube and depicts the use of a shroud to contain high-combustion pressures;

FIGS. 10 and 11 are cross-sectional views illustrating acceleration of a projectile down a launch tube in the ultrahigh velocity acceleration mode;

FIG. 12 is a table depicting various operating parameters for a projectile accelerating in the ultrahigh velocity acceleration mode as depicted in FIGS. 10 and 11;

FIG. 16 is a cross-sectional view of a launch tube illustrating the use of an exhaust system at the muzzle end to produce a rarefaction wave;

FIG. 17 is a graph depicting both flow of the gas medium due to the rarefaction wave and the path of the projectile through the launch tube;

DETAILED DESCRIPTION

Figure 1:
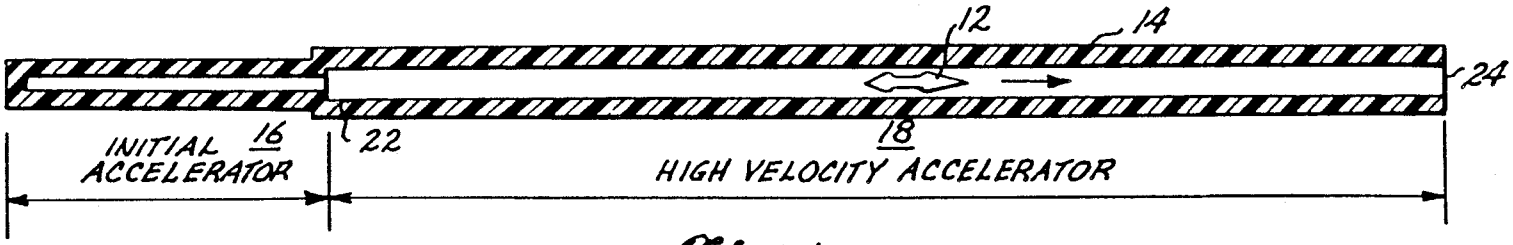
FIG. 1 is a cross-sectional view illustrating a projectile accelerating down a launch tube having both initial and high-velocity accelerator portions.

FIG. 1 is a cross-sectional view illustrating the acceleration of a projectile 12 down a launch tube 14. Launch tube 14 is divided into two sections, an initial accelerator section 16 and a high-velocity accelerator section 18. The purpose of initial accelerator 16 is to accelerate the projectile 12 to a velocity suitable for continued acceleration in the high-velocity accelerator 18. Each of the various projectile acceleration modes according to this invention requires an initial acceleration of the projectile to an initial velocity. Once this initial velocity is reached, the projectile is launched into the inlet, or breech 22 of the high-velocity accelerator 18 for subsequent acceleration through the length thereof, with the projectile emerging from the muzzle 24 of the launch tube. The various projectile acceleration modes and the considerations for initial accelerator velocities are described in detail herein below.

Figure 2:
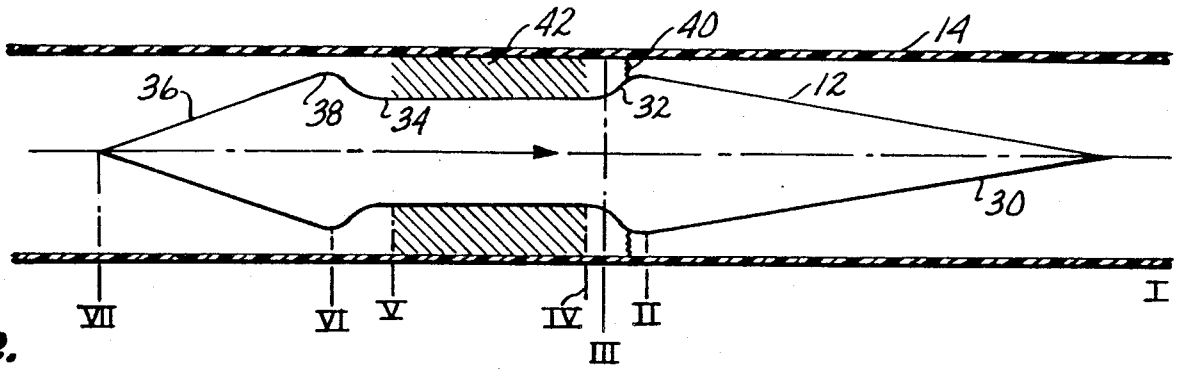
FIG. 2 is a cross-sectional view of the projectile within the launch tube and illustrates projectile acceleration in the subsonic combustion mode.

FIG. 2 is a cross-sectional view illustrating flight of the projectile 12 in the high-velocity accelerator portion 18 of launch tube 14 and depicts acceleration of the projectile 12 in the subsonic combustion mode. As shown, the projectile 12 is formed with a diffuser nose 30, which tapers over a shoulder 32 to a reduced diameter, cylindrical midsection 34. Following the midsection 34 is a plug-type nozzle 36 formed as a cone, pointing opposite the direction of flight, which increases to a diameter larger than the diameter of the midsection 34. The launch tube 14 is preferably formed of a high strength, lightweight material, such as KEYLAR (a polyamide material) composite. A shoulder 38 joins the nozzle 36 to the midsection 34.

The configuration of the projectile 12 and the inside surface of the cylindrical launch tube 14 forms a ramjet. In the subsonic combustion mode of acceleration, the launch tube 14 is filled with a gaseous propellant, i.e., fuel-oxidizer mixture (not shown). This gaseous propellant is, preferably, hydrogen and oxygen, although other combustible gases including, but not limited to, methane, ethane, propane and similar hydrocarbons may be used as the fuel gas.

To initiate ramjet operation, the projectile 12 is initially accelerated by the initial accelerator (16 of FIG. 1) to a local supersonic velocity of approximately Mach 2.6. At this velocity, the flow of hydrogen fuel and oxygen oxidizer around the diffuser 12 produces a weak shock wave (not shown) centered at the nose tip and a normal shock wave 40 at diffuser shoulder 32. The hydrogen and oxygen decelerate to a subsonic speed upon traversing the normal shock wave 40. The fuel-/oxidizer mixture is then ignited forming the shaded combustion chamber 42. The preferred ignition means for the mixture is described with respect to FIG. 4. The heated gases then flow around shoulder 38 and are accelerated to supersonic velocities past nozzle 36. Due to the heat addition provided by burning of the propellant in the combustion chamber 42, the pressure and momentum flux of the flow past the nozzle 36 exceeds the pressure and momentum flux of the flow ahead of the diffuser 30, thereby imparting an acceleration to projectile 12.

FIG. 3 is a Table of calculated values illustrating various operating parameters for the subsonic combustion mode of projectile acceleration as depicted in FIG. 2. These calculations were carried out using standard one-dimensional gas dynamic techniques. The flow field around the projectile was divided into seven stations I–VII, as shown in FIG. 2. Station I is at the tip of the diffuser 30, with station II being at the divergent shoulder 32 of diffuser 30, just prior to the shock wave 40. Station III is on the diffuser shoulder 32 just aft of shock wave 40. Stations IV and V represent the beginning, and end, respectively, of the combustion chamber 42. Station VI is at the shoulder 38 of the nozzle 36, with station VII being at the tip of nozzle 36. The working gases were assumed to follow the ideal gas law and to have an initial ratio of specific heats, $\gamma=1.4$. The initial temperature of the gas in the launch tube 14 was assumed to be 300° K. In addition, diffuser 30 was assumed to produce isentropic compression up to shoulder 32, followed by a normal shock 40 at the location of the diffuser shoulder 32.

Following the normal shock 40, the gas flow is decelerated to further reduce the Mach number at the entrance to the combustion zone 42. The diameter of the projectile at the combustion chamber 42 was assumed to be half the diameter at the diffuser shoulder 32. The heat addition was modeled as a change in the stagnation temperature between stations IV and V, accounting for the change in specific heat ratio, $\gamma$, and molecular weight that results from combustion. Constant-pressure adiabatic flame temperature calculations were carried out for various hydrogen-oxygen and hydrogen-air mixtures at the conditions present at station IV to determine the change in stagnation temperature between stations IV and V and the resulting gas properties at station V. The combustion calculations were decoupled from the gas dynamics, an approximation which is valid because the static pressure in the combustion zones does not vary significantly and the flame temperature is only weakly dependent on pressure.

The region between stations V and VII was assumed to flow in accordance with a standard convergent-divergent supersonic plug nozzle, with the flow being isentropic and frozen. This is a conservative assumption since the exhaust flow is actually expected to be close to equilibrium. It was determined that the frictional drag on the projectile was very small (less than 1.5% of the thrust) and could be neglected in comparison with the thrust. The equation of motion of the projectile down the launch tube was integrated while simultaneously solving the entire set of gas dynamic equations dealing with the ramjet cycle. The values in the Table shown in FIG. 3 are for a condition of premixed hydrogen and oxygen in the launch tube, with the relative hydrogen-oxygen concentration varying in a stepwise manner from breech to muzzle. It was assumed for these calculations that the combustion zone does not coalesce with the normal shock in the diffuser to form a detonation wave.

The Table of FIG. 3 gives data for the acceleration of projectiles to a final velocity of 2.5 kilometers per second. The data assume that the projectile was initially accelerated to a velocity of 1.0 kilometers per second. Four projectile masses are shown, i.e., 500, 100, 25 and 10 kilograms. The corresponding diameters for these three masses are 44.8, 26.2, 16.5 and 12.2 centimeters, respectively. Data are tabulated for both steel and Kevlar composite launch tube (barrel) materials. Shown are the initial gas pressures, maximum gas pressures, peak accelerations, ratio of barrel inner diameter to outer diameter, barrel length, barrel mass, and the masses of hydrogen fuel and oxygen oxidizer.

As the data of the Table in FIG. 3 establish, the subsonic combustion mode, as described with respect to FIG. 2, is capable of accelerating projectiles having a mass as high as 500 kilograms up to velocities of 2.5 kilometers per second, making use of reasonably sized launch tubes.

Figure 4:
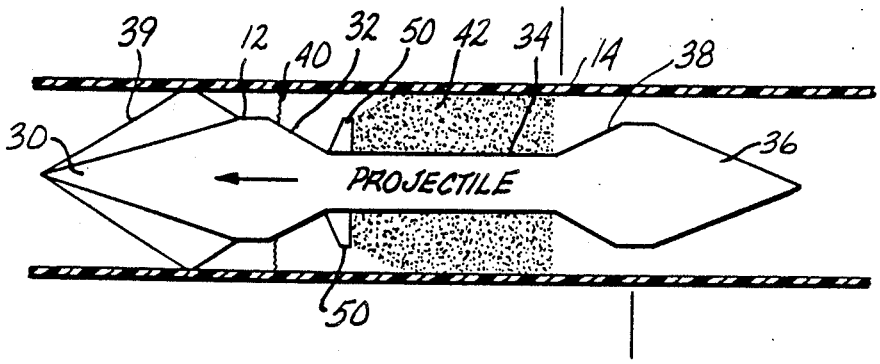
FIG. 4 is a cross-sectional view illustrating the projectile in the launch tube and depicts the use of catalytic coated flame holders to sustain combustion chamber ignition of the fuel.

FIG. 4 is an additional cross-sectional view illustrating a projectile 12 flying through the high velocity accelerator portion 18 of a launch tube 14 in the subsonic combustion mode. As before, the projectile 12 and launch tube 14 form a ramjet, with a diffuser 30, a diffuser shoulder 32, a combustion chamber 42, a nozzle 36, and a nozzle shoulder 38. As mentioned with respect to FIG. 2, in the subsonic combustion mode the fuel and oxidizer (preferably hydrogen and oxygen) produce a weak conical shock 39 which reflects from the launch tube 14 wall, followed by a normal shock 40 at the diffuser shoulder 32. The gas decelerates to subsonic flow upon traversing normal shock 40 and decelerates further prior to reaching the combustion chamber 42. To ignite this fuel, flame holding fins 50 are mounted to the projectile midsection 34, just aft of the diffuser shoulder 32. The flame holding fins 50 are preferably coated with a catalytic agent to promote combustion. The combustion initiated by the flame holders 50 spreads through the combustion chamber 42 and, if necessary, may be aided with swirl vanes (not shown).

Numerous other techniques for igniting the fuel-oxidizer mixture within the combustion zone 42 are contemplated. Such techniques include: RF arc heating, laser heating, and spark discharge ignition.

Figure 5:
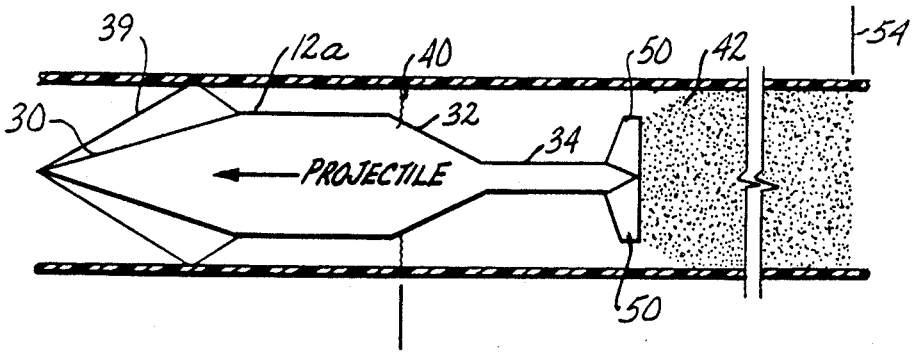
FIG. 5 is a cross-sectional view depicting the projectile in the launch tube and illustrates the use of aft-mounted catalytic coated flame holders to produce combustion behind the accelerating projectile.

FIG. 5 is a cross-sectional view illustrating an alternative projectile configuration for subsonic combustion acceleration. Here, a projectile **12*a* is shown accelerating down a cylindrical launch tube 14. As with the embodiment of FIG. 4, projectile 12*a* includes a conical diffuser 30, a diffuser shoulder 32, and a reduced-diameter midsection 34. Here, however, the catalytic coated flame holders 50 are mounted on the aft portion of midsection 34, there being no discrete nozzle 36**.

The gas flow over the projectile **12*a* produces a weak shock wave 39 at the diffuser 30 and a normal shock wave 40 extending from shoulder 32. Relative gas flow prior to normal shock wave 40 is supersonic with the gas slowing to a relative subsonic speed immediately after normal shock wave 40**.

The fuel and oxidizer in the gas are ignited by the catalytic coated flame holders 50 producing combustion behind the projectile **12*a*, in the combustion zone 42. The flow of the gas thermally chokes (i.e., the gas reaches Mach 1.0) at a thermal choking zone 54**.

Whereas the velocity range that can be achieved by the acceleration technique illustrated in FIG. 5 (approximately 0.8–1.6 kilometers per second) is lower than that of the subsonic combustion mode described with respect to FIG. 4, the thermally choked mode as depicted in FIG. 5 could serve as an initial accelerator for a higher speed device.

Figure 6:
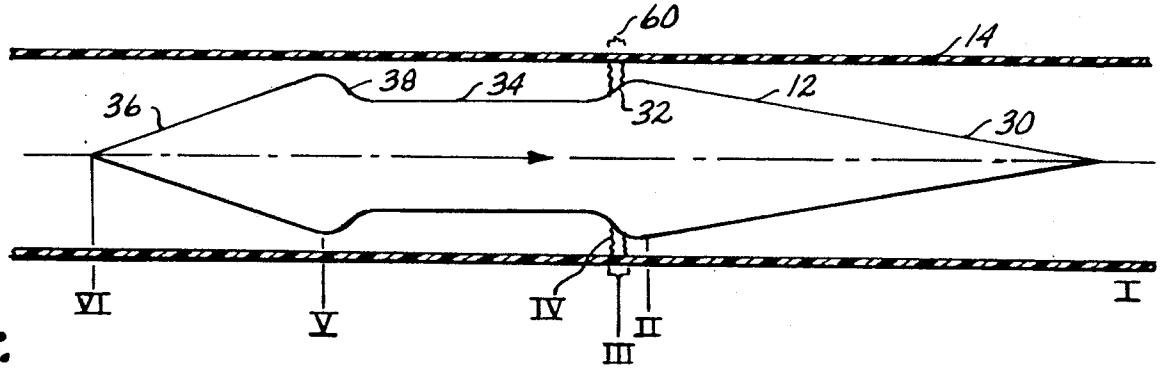
FIG. 6 is a cross-sectional view depicting the projectile in the launch tube and illustrates the overdriven detonation wave mode of projectile acceleration.

FIG. 6 is a cross-sectional view of a projectile 12 within a cylindrical launch tube 14 and illustrates projectile acceleration in the overdriven detonation wave mode. A feature of the present invention is that a fixed geometry projectile may be used in both the subsonic combustion mode as shown in FIG. 2, and the overdriven detonation wave mode illustrated in FIG. 6. Thus, for the same projectile geometry, the subsonic combustion mode may be used as an initial accelerator for the overdriven detonation wave mode.

Projectile 12 includes a conical diffuser 30 having a shoulder 32 joined to a cylindrical midsection 34. A plug-type nozzle 36 is conical, having its point at the aft end of the projectile 12. The conical plug nozzle 36 has a shoulder 38 joined to the midsection 34.

Before entering the overdriven detonation wave mode, the projectile 12 is initially accelerated to approximately 2.0–2.5 kilometers per second. The launch tube 14 is filled, as in the subsonic combustion mode of FIG. 2, with a detonable mixture of fuel (preferably hydrogen) and an oxygen oxidizer. The mixture includes excess oxygen in the initial portion of the launch tube 14. In this mode, however, the projectile moves faster than the Chapman-Jouguet detonation speed of the detonable mixture. As a result, an overdriven detonation wave 60 stands in the divergent region (i.e., shoulder 32) of the diffuser 30. In this overdriven detonation wave 60, combustion occurs in the immediate vicinity of the shock front. The plug-type nozzle 36 keeps the detonation wave 60 overdriven, maintaining detonation wave 60 in place on shoulder 32.

A dynamic and thermodynamic analysis of the overdriven detonation wave cycle was performed, with the results being given in the Table of FIG. 7. For this analysis, six thermodynamic stations, identified as I–VI, are positioned as shown in FIG. 6. Station I is at the point of the diffuser cone 30. Stations II–IV are at positions immediately before, within, and subsequent to the overdriven detonation wave 60, respectively. Station V is at the nozzle shoulder 38, with station VI being at the point of the nozzle cone 36.

The calculations tabulated in FIG. 7 were for projectiles having masses of 500, 100, 25 and 10 kilograms injected into the overdriven detonation wave mode at a velocity of 2.5 kilometers per second. Configurations capable of achieving final velocities of both 4 and 5 kilometers per second were computed. Calculations were made for both projectiles with combustion-containing shrouds (see the discussion with respect to FIG. 9) and for nonshroud projectiles. A launch tube (i.e., barrel) material of KEVLAR (a polyamide material) composite was considered. Maximum gas pressures, peak projectile accelerations, barrel lengths, barrel mass, and fuel and oxidizer gas masses are all tabulated.

In the analysis of the overdriven detonation wave mode, the detonation wave (60 in FIG. 6) was split into a shock wave immediately followed by a thin heat release zone. Station III is positioned after the shock wave and prior to this heat release zone. The calculations were carried out using a method similar to that used for the lower speed subsonic combustion device previously described. The initial temperature in the tube was taken to be 300° K. The working gases were assumed to follow the ideal gas law, with an initial ratio of specific heats, $\gamma$, of 1.4. The total temperature rises for which the calculations were done were based on the results of separate adiabatic flame temperature calculations for the specific fuel-oxidizer mixtures of interest. Changes in specific heat ratio, $\gamma$, gas composition and molecular weight were included.

No heat release due to recombination in the nozzle expansion process was considered, i.e., the nozzle flow was considered to be frozen. Some recombination in the nozzle may, however, occur thereby increasing the acceleration performance of the projectile.

The cycle calculations show that the overdriven detonation ramjet mode works well at relative gas velocities at station I of Mach 5.0–7.0. The cycle efficiencies are on the order of 0.25–0.30 and the effective thrust pressures divided by the maximum detonation pressure are typically 0.10–0.20.

Calculations were done for diffuser 30 total pressure ratios (upstream of the detonation wave 60) of 1.0, ~0.7, and ~0.5. These diffuser stagnation pressure losses were found to have essentially negligible effect on the acceleration of the projectile. This is because the reduction in stagnation pressure across the overdriven detonation wave is typically by a factor of 20 to 100, and estimated reductions in the diffuser by factors of 1.5 or 2.0 are relatively insignificant.

The above-described thermodynamic cycles were calculated ignoring friction. For these cycles, the main loss mechanism is not friction but, rather, the losses in stagnation pressure due to the oblique shocks in the diffuser and particularly those occurring in the overdriven detonation wave. However, a conservative estimate of 0.003 was taken for the projectile skin friction coefficient. With this assumed value for the skin friction coefficient, the thrust on the projectile will be reduced by up to ~7 percent. Thus, the skin friction penalty is relatively small.

Further, calculations were made for projectile ablation at the nozzle 36 throat. For these calculations, an estimated friction factor of 0.003 was used. Further, a projectile diameter of 44.8 cm was assumed, and the projectile was assumed to be accelerated from 2.5 kilometers per second to 5.0 kilometers per second in the overdriven detonation wave mode. The initial gas mixture in the tube was taken to be $2H_2+2.65O_2$ at the low-speed end of the tube with progressively less dense $H_2$-$O_2$ mixtures in the higher speed sections of the tube. The maximum cycle pressure was taken to be 11,450 atmospheres. From the relevant cycle calculations, the temperature, $T_o$, at the throat was taken to be 4500° K. and the wall temperature of the projectile 12 was assumed to be 4000° K. The material of the nozzle throat of projectile 12 was assumed to be graphite and to require the heat of evaporation of graphite to be ablated. With these assumptions, the projectile surface retreat at the nozzle throat was calculated to be ~0.4 cm. This is only about one percent of the projectile diameter.

The high temperature, high pressure region associated with the projectile travels with the projectile, distributing the heat over the entire length of the launch tube (barrel) 14. Thus, the average temperature rise of the launch tube 14 resulting from this heat load is relatively small.

FIGS. 8A and 8B depict the pressure profile appearing on the projectile in the subsonic combustion and the overdriven detonation modes. More specifically, FIG. 8A is a cross-sectional view of a projectile 12 being accelerated in a launch tube 14. The overdriven detonation wave 60 is shown formed on the diffuser shoulder (divergent region) 32.

FIG. 8B is a plot of relative pressure versus position on the projectile. In the overdriven detonation wave mode, graph labelled "O.D.", it is noted that the pressure rises sharply at the overdriven detonation wave 60, and maintains at a maximum level throughout the projectile midsection 34, thereafter tapering across the nozzle 36. Shown in dotted line, and labelled "S.C.," is a corresponding pressure plot across the projectile for the subsonic combustion mode.

While the projectile 12 can be made aerodynamically stable, tending to seek the center of the launch tube 14, active stabilization techniques may be employed, such as guide rails, means for imparting a stabilizing projectile spin, or other suitable stabilization approaches, for controlling the flight of projectile 12 down the launch tube 14.

It is noted from FIGS. 3 and 7 that peak gas pressures within the launch tube 14 can be quite high for both the subsonic combustion and the overdriven detonation wave modes of acceleration. The launch tube 14 must be designed for full static pressure loading, even through the duration of the pressure pulse induced at any point in the launch tube 14 is very short. To circumvent this problem, a shrouded projectile configuration was developed as shown in FIG. 9.

FIG. 9 is a cross-sectional view of a modified projectile 12*a* accelerating within a cylindrical launch tube 14. The projectile 12*a*, as before, is provided with a conical diffuser 30 in its forward portion. Diffuser 30 terminates at a shoulder 32 which, in this embodiment, continues as a constant diameter section 66, tapering to form an aft cone 68. A series of struts 70 extend from diffuser 30 back to a cylindrical shroud 72. The outer surface of shroud 72 is cylindrical, being slightly smaller than the inner surface of launch tube 14. The forward inner surface of shroud 72 is hollowed to form the combustion chamber 42. Combustion chamber 42, which forms the heat addition zone for the ramjet cycle, is contained within shroud 72, thereby avoiding high-pressure loading on the launch tube 14. By use of the shroud 72 the launch tube may be made considerably lighter than if the shroud 72 were not used.

At the aft end of the inner portion of shroud 72, a constriction 74 formed by an annular shoulder 75 constitutes the throat of the nozzle 76.

Friction between the inner surface of the launch tube 14 and the outer surface of shroud 72 is a potential source of drag on the projectile 12. However, an examination of the literature indicates that the low friction experienced by electric rail gun devices operating in this velocity range is due to the generation of an extremely high temperature plasma which allows nearly frictionless rubbing in the high velocity section of the rail gun. Current experiments with rail guns verify that only a few percent of the kinetic energy of the projectile is lost to friction. In addition, the aforementioned heat transfer calculations indicate that ablation rates are sufficiently low, such that operation rates for the present accelerator are not seriously compromised. The use of the shroud 72 has particular import for applications of the present invention in which mobility is desirable.

The overdriven detonation wave mode of acceleration illustrated in FIG. 6 can be used to accelerate the projectile up to at least the 4–6 kilometers per second range and possibly higher. At higher speeds, the limited heat release capability of the drive gas is no longer capable of generating the desired large thrusts required for continued projectile acceleration. Yet higher projectile velocities are achievable using layered detonation as shown in FIGS. 10 and 11.

FIGS. 10 and 11 are both cross-sectional views illustrating projectile 12*c* and 12*d* respectively flying down a launch tube 14 in the ultrahigh velocity acceleration mode. Each of projectiles 12*c* and 12*d* has a conical diffuser in its forward section, with a conically tapered aft section 80. To illustrate alternative configurations of the projectile, the FIG. 10 embodiment 12*c* is shown with an extended cylindrical midsection 81, the projectile 12*d* of FIG. 11 lacking such a midsection.

Disposed within the launch tube 14 is a cylindrical liner 82 formed of thin metal, plastic or carbon composite which is supported by suitable supports (not shown). The diameter of the liner 82 is selected to be larger than the outside diameters of projectiles 12*c* and 12*d* whereby projectiles 12*a* and 12*d* freely fly inside of liner 82. The liner 82 is filled with a gaseous medium of low molecular weight, preferably hydrogen gas.

In the embodiment of FIG. 10, the annular zone between the liner 82 and the inside surface of the launch tube 14 is filled with a detonable gas 86, which is preferably a stoichiometric mixture of hydrogen gas ($H_2$) and oxygen gas ($O_2$). Other detonable gas mixtures may also be used such as mixtures of oxygen gas with methane, ethane or propane. For the embodiment of FIG. 11, this annular zone is filled with a solid or liquid high explosive 88, such as, but not limited to, PETN or nitromethane.

Each of the projectiles 12*c* and 12*d* is initially accelerated to a velocity which exceeds the detonation speed of either the detonable gas 86 of FIG. 10 or the liquid or high explosive 88 of FIG. 11. The use of hydrogen gas within the sleeve 82 keeps the projectiles 12*c* and 12*d* Mach numbers, and hence the temperature and pressure on the projectiles 12*c* and 12*d* within acceptable limits.

The diffuser nose 30 of projectiles 12*c* and 12*d* is designed to exhibit low efficiency thereby producing a strong oblique bow shock wave 90 which extends into the annular zone. This oblique bow shock 90 is sufficient to initiate detonation of either the detonable gas 86 or the explosive 88. As a result of this detonation, the explosive products expand, forcing the inner sleeve 82 inward and compressing the hydrogen gas behind the projectiles 12*c* and 12*d*. The use of the inner sleeve 82 prevents shear layer mixing between the explosive products and the hydrogen atmosphere in the inner sleeve 82, thereby avoiding a significant source of drag on projectiles 12*c* and 12*d*.

For the high energy embodiment of FIG. 11, as the liner 82 closes behind the projectile 12*d*, a choke throat is formed which imparts an acceleration to the projectile 12*d*.

Calculations were performed on the ultrahigh velocity acceleration modes depicted in FIGS. 10 and 11. For the example shown in FIG. 10, wherein detonable hydrogen and oxygen gas was used, it was assumed that the flow of hydrogen around the projectile 12*c* is everywhere supersonic. An ideal hydrogen gas having a constant specific heat ratio, $\gamma$ of 1.4 was assumed. Also assumed was an ideal stoichiometric mixture of hydrogen and oxygen gas, with an initial specific heat ratio, $\gamma=1.4$. The detonation wave was modeled using Chapman-Jouguet theory, including changes in specific heat ratio, gas composition and molecular weight. The shock waves, detonation wave and expansion fans were treated two-dimensionally, although the actual projectile is axisymmetric. This greatly simplified the calculations without significantly affecting the nature of the results obtained.

Various stations I–X were used to calculate the thermodynamic cycle of the FIG. 10 detonable gas embodiment. An oblique shock separates stations II and III, and an oblique Chapman-Jouguet detonation followed by an expansion fan separates zones VI and VIII. Under certain conditions, the detonation wave could be an overdriven detonation wave, in which case an expansion fan would not be present. The conditions of stations III and VIII were determined by matching pressure and flow angle. The details of the equilibration of the flows between stations III and IV (inner stream) and stations VIII and IX (outer stream) were ignored. The flow as, to a first approximation, considered to be isentropic between stations III and IV and between stations VIII and IX. The conditions at stations IV and IX were determined by matching pressures with the flow parallel to the launch tube 14 axis. The two streams were assumed to expand isentropically and in pressure equilibrium with each other from stations IV and IX to stations V and X. Given the rear cone angle of the projectile 12*c*, the lateral velocity of the dividing streamline in the nozzle was calculated. This velocity was sufficiently low with respect to the sonic velocities of the streams, such that the assumption of pressure equilibrium between the two streams during the nozzle expansion is valid. The entire cycle calculation was done initially without consideration of the effects of friction. The thrust on the projectile 12*c* was then calculated from the pressures and momentum fluxes in zones I, V, VI and X. A separate calculation was then made of the frictional drag on the projectile 12*c*, using the dynamic pressures of the hydrogen stream and a conservative value of 0.003 for the skin friction coefficient. A calculation of the cycle net thrust and efficiency was then made.

The calculation techniques for the liquid or solid high explosive embodiment depicted in FIG. 11 were very similar to those described with respect to the detonable gas example of FIG. 10. Ideal $H_2$ was assumed for the inner stream gas, as before. However, the outer stream was modeled using equation-of-state data for actual high-explosive product gases. Conditions at stations III and VIII were matched assuming that a strong oblique wave shock solution occurs between stations II and III. This produces subsonic flow in region III. The strong shock solution turns out to be very nearly a normal shock. The two streams are then assumed to expand isentropically from station III to V (inner stream) and from station VIII to X (outer stream). The inner stream was taken to be choked at station V. This determined the pressure at station V and, hence, the amount of high explosive necessary to choke the inner $H_2$ stream. The thrust on the projectile 12*d* was determined, in this case, from the pressures on the fore 30 and aft 80 parts of the projectile 12*d*. A separate calculation was made of the frictional drag on the projectile 12*d* and this was subtracted from the inviscid thrust to yield the net thrust. If friction between the two streams is disregarded, it does not matter how slowly the dividing streamlines close in behind the projectile 12*d*. Since the hydrogen medium is subsonic behind the projectile, the choking effect of the formed throat always imparts an acceleration to the projectile 12*d*.

The two streams were assumed to be separated by a thin metallic sleeve 82. The detailed motion of the metallic sleeve 82 can only be obtained after very laborious calculations. Instead, it was assumed that the axial velocity of the sleeve 82 remained unchanged as it flowed past the projectile (in a coordinate system with the projectile at rest). From data found in references on explosives, it was assumed that the inner sleeve 82 moves inwardly at a 1.5 kilometer per second rate after detonation of the explosive 88. With this description for the motion of the inner sleeve 82, and taking an appropriate value for the skin friction coefficient, it was determined that the friction between the hydrogen gas and the inner sleeve 82 creates changes in the condition at the throat (station V) of only 10–20 percent for speeds up to 24 kilometers per second. This causes only minor reductions in thrust and efficiency for this mode of acceleration up to speeds of 24 kilometers per second.

The Table of FIG. 12 sets forth the operating parameters for acceleration of the projectile in the ultrahigh velocity accelerating mode as depicted in FIGS. 10 and 11. It was assumed that the hydrogen gas was initially at 300° K. and that the projectile forward and rear cones 30, 80, respectively, had 10° taper half-angles. Shown are initial gas pressure, maximum gas pressure, ratio of effective thrust pressure to maximum gas pressure, and efficiency for a projectile final velocity of 8 kilometers per second using the detonable stoichiometric hydrogen and oxygen gas example of FIG. 10, and final velocities of 12 and 24 kilometers per second for the high energy explosive example of FIG. 11.

Figure 13:
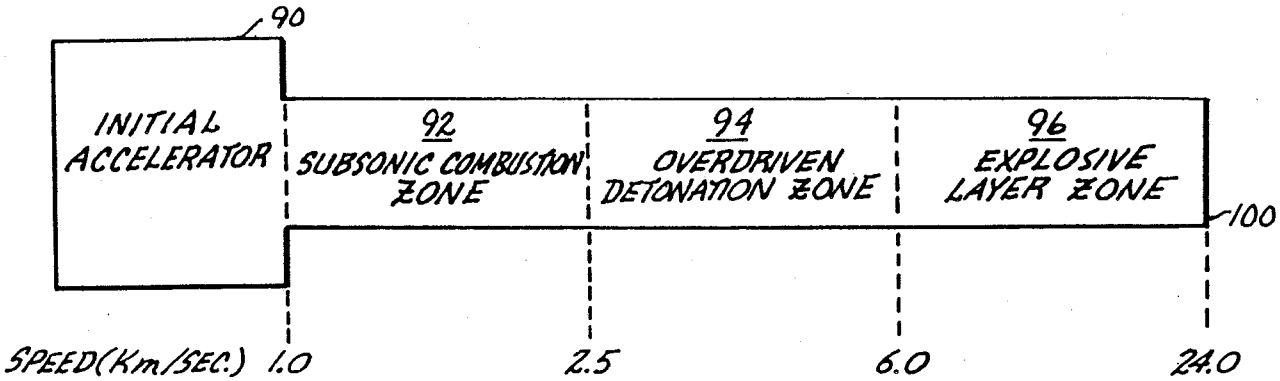
FIG. 13 is a cross-sectional view of a launch tube having successive acceleration modes and illustrates projectile speeds achieved by accelerating through the various acceleration zones.

The various aforedescribed acceleration modes may be used in one overall accelerator to achieve projectile hypervelocities. FIG. 13 is a cross-sectional view of a launch tube illustrating the successive projectile acceleration mode zones. The projectile (not shown) is initially accelerated by an initial accelerator 90 to a speed of approximately 1.0 kilometers per second. Initial accelerator 90 may be comprised of a conventional powder gum, light gas gum, or other suitable device.

Once accelerated to approximately 1.0 kilometers per second, the projectile is injected into the subsonic combustion zone 92, wherein the projectile acceleration in accordance with the subsonic combustion mode described with respect to FIG. 2 is achieved.

The projectile speed in the subsonic combustion zone reaches a velocity of approximately 2.5 kilometers per second, at which point the overdriven detonation wave zone 94 is entered. Overdriven detonation wave acceleration is accomplished as is described with respect to FIG. 6. The overdriven detonation wave zone 94 raises the projectile velocity to approximately 5–6 kilometers per second, or greater. The projectile then enters the ultrahigh acceleration explosive layer zone 96. Velocities as high as 24 kilometers per second are achieved in the explosive layer zone 96 in accordance with the discussion given with respect to FIGS. 10 and 11. Following acceleration through the explosive layer zone 96, the projectile leaves the launch tube at its muzzle 100.

The use of successive mode projectile acceleration as illustrated in FIG. 13 is capable of accelerating relatively large projectiles to intercontinental, earth orbit, or earth escape velocities, suggesting numerous applications.

For those acceleration modes wherein the propulsive energy is provided by a gaseous combustible mixture, the projectile should be operated within a narrow Mach number to thereby maximize efficiencies. For an accelerating projectile, this implies an increasing speed of sound, i.e., a decreasing gas density at constant temperature. More importantly, however, it was found that unless the density of the gas in the launch tube decreased with increasing projectile velocity, pressures on the projectile and launch tube became excessive. Therefore, the various approaches set forth in FIGS. 14–16 were developed for reducing gas densities in accordance with increased projectile velocity during its travel down the launch tube.

Figure 14:
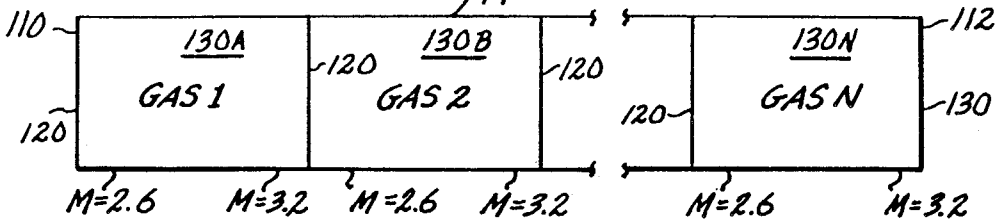
FIG. 14 is a cross-sectional view of a launch tube divided into different gas-filled segments by means of diaphragms.

FIG. 14 is a cross-sectional view of a cylindrical launch tube 14 having an inlet, or breech end 110 and a muzzle end 112. Here, the launch tube is broken down into a series of N segments. The boundaries of the various segments are defined by a plurality of diaphragms 120. Each diaphragm 120 is circular having a diameter equal to the inner diameter of the launch tube 14. The diaphragms 120 are secured within the launch tube 14 such that the face of each diaphragm 120 is perpendicular to the longitudinal axis of the launch tube 14. The positioning of each diaphragm 120 defines a series of segments $\mathbf{130}_A$, $\mathbf{130}_B$–$\mathbf{130}_N$. Each segment is filled with a different combustible gas mixture, here identified GAS 1–GAS N. The diaphragms 120 are such that a gas in a segment is isolated from the gases in adjoining segments. However, each diaphragm 120 is easily penetrable by the projectile (not shown) as it accelerates down launch tube 14.

For the subsonic combustion mode of acceleration, a design goal in the segmented launch tube of FIG. 14 was to maintain the projectile local Mach number between approximately 2.65 and approximately 3.3. As the projectile enters the breech 110 it is at its lowest relative velocity in launch tube 14, thereby requiring the densest gas mixture with the lowest speed of sound, but still within the combustion limits. Thus, the first segment $\mathbf{130}_A$ GAS 1 could be comprised of $2H_2+6O_2$. The speed of sound of GAS 1 is such that the projectile, after being initially accelerated, will enter the first segment $\mathbf{130}_A$ at Mach 2.65. The length of the first segment $\mathbf{130}_A$ and the acceleration of the projectile define the positioning of the righthand diaphragm 120 in the first segment $\mathbf{130}_A$. Here, this right-hand diaphragm 120 is positioned at the point at which the projectile reaches Mach 3.3. The projectile then penetrates the diaphragm 120 between segments $\mathbf{130}_A$ and $\mathbf{130}_B$ entering the GAS 2 environment. GAS 2 is selected of higher speed of sound, whereby the projectile enters at a local Mach 2.71 and exits at a local Mach 3.26. This process continues until the projectile enters the final segment $\mathbf{130}_N$. The final segment $\mathbf{130}_N$ contains the highest speed of sound gas, as, for example, $7H_2+O_2$. Again, the speed of sound of the gas and positioning of the diaphragms 120 are such that the projectile enters the final segment $\mathbf{130}_N$ at a local Mach 2.74 and exits at a local Mach 3.2.

The following table sets forth sample values for a five segment (i.e., N=5) launch tube 14.

| Segment No. | $L/L_1$ | Gas Mixture | Sound Speed (300° K., m/sec) |
|---|---|---|---|
| 1 | 1.0 | $2H_2 + 6O_2$ | 378 |
| 2 | 0.9 | $2H_2 + 1.85O_2$ | 461 |
| 3 | 1.0 | $2H_2 + O_2$ | 540 |
| 4 | 2.0 | $4H_2 + O_2$ | 661 |
| 5 | 3.0 | $7H_2 + O_2$ | 779 |

Where $L/L_1$ is the ratio of segment length to the length of the first segment. The Mach number remains between 2.65 and 3.3 at all times, resulting in modest peak pressure ratios.

Thus, by implementation of the segmented launch tube as illustrated in FIG. 4, the projectile is maintained within a narrow Mach number range, thereby maximizing its efficiency and maintaining pressure on the projectile within acceptable limits.

Figure 15:
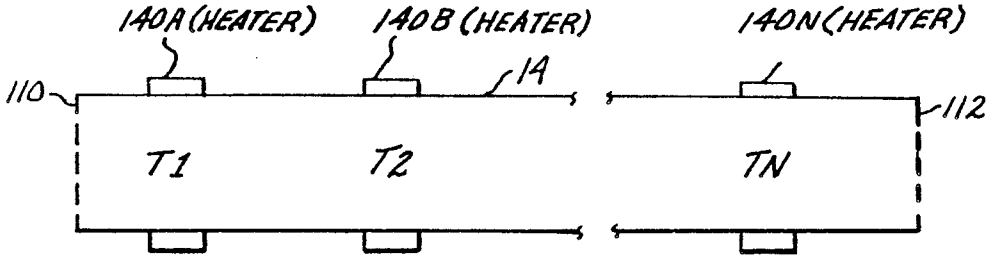
FIG. 15 is a cross-sectional view of a launch tube illustrating the use of predeterminedly located heaters to vary the temperature of the gas medium down the launch tube.

FIG. 15 illustrates an alternative method for maintaining the pressure on the projectile and launch tube within acceptable limits by varying the speed of sound of gas down the launch tube. Here, shown in cross section is a launch tube 14 having a breech 110 and a muzzle 112. Positioned down the length of launch tube 14, around the circumference thereof, are predeterminedly located heaters $\mathbf{140}_A$–$\mathbf{140}_N$. Launch tube 14 is filled with a single gas mixture, preferably a combination of hydrogen and oxygen. The speed of sound of the gas is varied by varying its temperature, as controlled by the heaters $\mathbf{140}_A$–$\mathbf{140}_N$. Thus, in the vicinity of the first heater $\mathbf{140}_A$, a first temperature $T_1$ is produced. This temperature $T_1$ is selected to produce a desired local speed of sound and, thus, a given Mach for the projectile as it enters the breech 110. As the projectile accelerates down launch tube 14, subsequent heaters $\mathbf{140}_B$–$\mathbf{140}_N$ produce higher temperature local gases $T_2$–$T_N$, respectively. The temperatures are selected to maintain the projectile at a relatively constant Mach number as it accelerates down launch tube 14.

While numerous conventional types of heaters $\mathbf{140}_A$–$\mathbf{140}_N$ may be employed for this application, either RF arc or laser heaters are ideally suited to this application.

FIG. 16 illustrates a third alternative for maintaining the peak pressure on the projectile and the launch tube within acceptable limits. Shown in cross section is a launch tube 14 having a breech 110 and a muzzle 112. Affixed to the muzzle end 112 of the launch tube 14 is an exhaust system, indicated generally at 150. The exhaust system 150 has various vents to ambient, or a reduced pressure sink, indicated at 150a–150c. Positioned within launch tube 14, just prior to the exhaust system 150, is a diaphragm 160 which seals gases on one side of the diaphragm from those gases on the opposite side. In addition, a second diaphragm 162 is placed in the muzzle 112.

Just prior to the projectile 170 being injected into the breech 110, the first diaphragm 160 is ruptured, thereby producing a nonsteady rarefaction wave down launch tube 14. This rarefaction wave accelerates the gas in launch tube 14 towards the muzzle 112 and drops the pressure ahead of the projectile 170.

FIG. 17 is a graph, plotting time versus distance down the launch tube 14 of FIG. 16 for the particular case of a premixed hydrogen-air propellant. Shown is the projectile path, as it enters the launch tube 14 at a velocity of 1.15 kilometers per second, exiting, through the second diaphragm 162, at 2 kilometers per second. Also depicted on graph 17 is the gas flow within launch tube 14 produced by the rarefaction wave. The speed of sound in the gas is 0.407 kilometers per second, at a temperature of 300° K. The centered expansion fan produced at the exhaust system 150 upon rupturing of first diaphragm 160 results in the various gas velocities in the launch tube 14 at the relative positions as shown.

Figure 18:
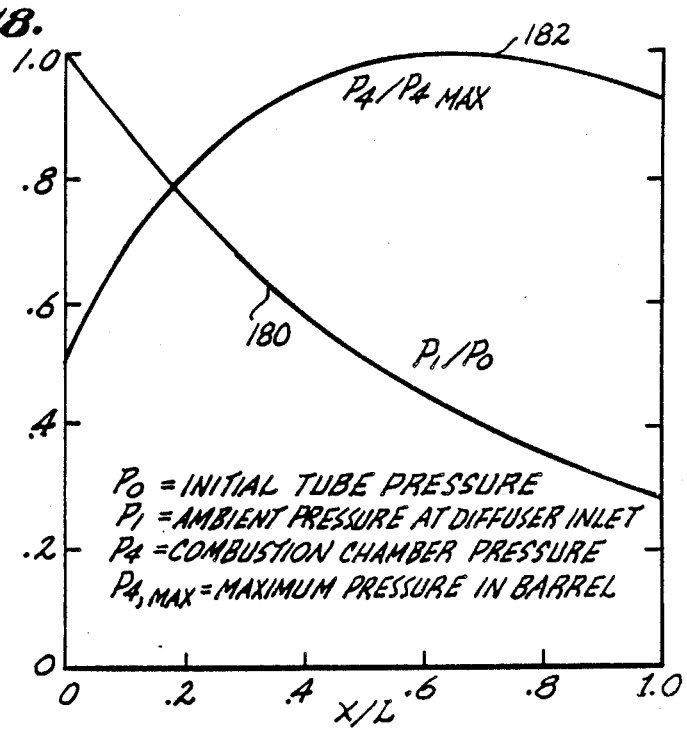
FIG. 18 is a graph depicting the various pressure ratios existing in the launch tube during the occurrence of a rarefaction wave.
Figure 19:
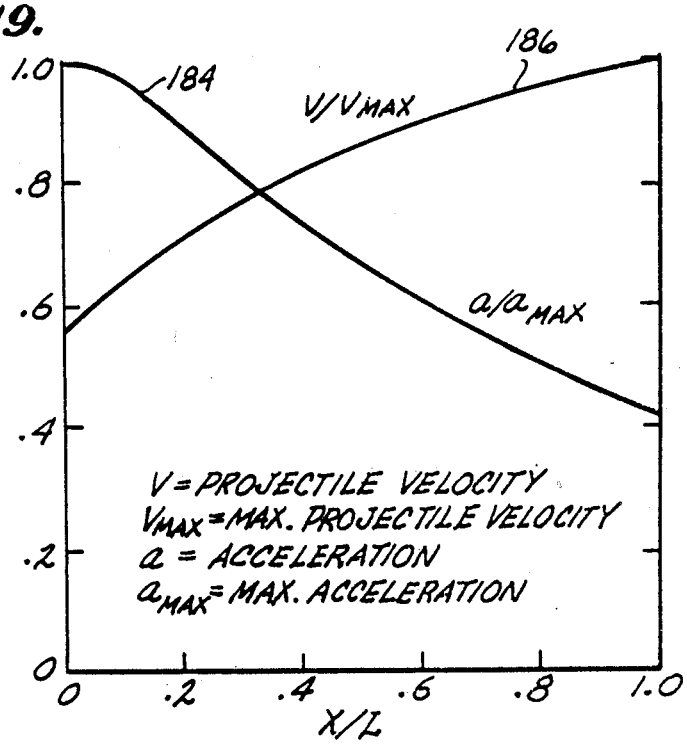
FIG. 19 is a graph depicting velocity and acceleration ratios of the projectile in the launch tube in the presence of a rarefaction wave.

FIGS. 18 and 19 show the nondimensional, self-similar, pressure, velocity and acceleration profiles of the FIG. 16 system. More specifically, FIG. 18 includes a graph 180 which depicts the ratio of ambient pressure at the diffuser inlet of the projectile to initial launch tube pressure. Graph 182 depicts the ratio of combustion chamber pressure to maximum combustion chamber pressure in the launch tube (barrel).

Here, the horizontal axis is a normalized launch tube of length 1.0, with the vertical axis being similarly normalized to maximum pressure.

The first graph 184 of FIG. 19 depicts the ratio of acceleration of the projectile to maximum acceleration over the length of the launch tube, here normalized to 1.0. The second graph 186 depicts the ratio of projectile velocity to its maximum velocity. From the graphs of FIGS. 18 and 19, it is seen that as the projectile velocity increases down the launch tube, gas pressure within the launch tube decreases at a corresponding rate, thereby tending to limit the peak pressures to acceptable levels.

In summary, apparatus and a method for the acceleration of a projectile to hypervelocities have been described in detail. Acceleration can be accomplished in one of three different modes: subsonic combustion, overdriven detonation wave, or high energy explosive. In addition, a single projectile can be sequentially accelerated through each of these modes, such that hypervelocities are achievable. Further, several techniques for maintaining the projectile at a relatively constant Mach number and thus limiting peak pressures to acceptable levels as it accelerates down the launch tube have been described. These techniques include a segmented launch tube, a launch tube filled with a gas which exhibits a smooth variation of composition down the tube, a launch tube having provided heaters for varying gas temperature and the production of a launch tube rarefaction wave synchronized to the acceleration of the projectile.

A particular feature of the present invention is that a projectile is fired into a launch tube containing a combustible mixture without creating a combustion wave that precedes the projectile.

The various acceleration modes described employ relatively well known and understood scientific principles, rendering this projectile acceleration apparatus and method imminently adaptable for numerous applications including: the intercontinental delivery of payloads, the firing of projectiles into earth orbit or earth escape velocities, the production of megajoules of X-rays by accelerating a projectile to a hypervelocity and then directing the projectile to impact a suitable target, controlled thermonuclear fushion, and applications for supplementing or replacing conventional launchers.

While preferred embodiments of the invention have been described in detail, it should be apparent that many modifications and variations thereto are possible, all of which fall within the true spirit and scope of the invention.

The embodiments of the invention in which an exclusive property or privilege is claimed are defined as follows:

1. Apparatus for accelerating a projectile comprising:
a launch tube having an inlet end and a muzzle end;
a projectile disposed within said launch tube for acceleration from said inlet end to said muzzle end, said projectile and launch tube forming a ramjet;
a combustible gaseous mixture contained within said launch tube;
means for varying the density of said combustible gaseous mixture in a predetermined manner from the inlet end to the muzzle end of said launch tube to increase the speed of sound in a predetermined manner from the inlet end to the outlet end so that, as said projectile accelerates through said launch tube, the Mach number of said projectile is maintained within a predetermined range; and
means for igniting said combustible gaseous mixture.

2. The apparatus of claim 1, wherein said meas for varying the density of said combustible gaseous mixture decreases the density of said combustible gaseous mixture from said inlet end to said muzzle end.

3. The apparatus of claim 1, wherein said means for varying the density of said combustible gaseous mixture decreases the density of said combustible gaseous mixture at predetermined positions between the inlet end and the muzzle end of said launch tube.

4. Apparatus for accelerating a projectile comprising:
a launch tube having an inlet end and a muzzle end, said launch tube being divided into a plurality of segments, each of said segments being filled with a combustible gaseous mixture having a predetermined density, said combustible gaseous mixtures being arranged in said segments in order of decreasing density from said inlet end to said muzzle end;
a projectile disposed within said launch tube for acceleration from said inlet end to said muzzle end, said projectile and launch tube forming a ramjet; and
means for igniting said combustible gaseous mixtures.

5. The apparatus of claim 4, wherein the segments of said launch tube are defined by diaphragms mounted within said launch tube, said diaphragms isolating the combustible gaseous mixture in one segment from the combustible gaseous mixture in adjoining segments while being penetrable by said projectile.

6. The apparatus of claim 4, wherein each of said segments is filled with a different combustible gaseous mixture.

7. The apparatus of claim 6, wherein said combustible gaseous mixtures comprise mixtures having different ratios of the same constituent gases.

8. The apparatus of claim 7, wherein said constituent gases are hydrogen and oxygen.

9. Apparatus for accelerating a projectile comprising:
a launch tube having an inlet end and a muzzle end, said launch tube being divided into a plurality of segments;
a projectile disposed within said launch tube for acceleration through said segments from the inlet end to the muzzle end, said projectile and launch tube forming a ramjet; and
a plurality of combustible gaseous mixtures, one of said combustible gaseous mixtures being contained within each of the segments of said launch tube, each of said combustible gaseous mixtures having a predetermined composition and density such that as said projectile accelerates through successive segments, the Mach number of said projectile is maintained within a predetermined range; and
means for igniting said combustible gaseous mixtures.

10. The apparatus of claim 9, wherein the segments of said launch tube are defined by diaphragms mounted within said launch tube, said diaphragms isolating the combustible gaseous mixture in one segment from the combustible gaseous mixture in adjoining segments while being penetrable by said projectile.

11. The apparatus of claim 9, wherein each of said segments is filled with a different combustible gaseous mixture.

12. The apparatus of claim 11, wherein said combustible gaseous mixture comprise mixtures having different ratios of the same constituent gases.

13. The apparatus of claim 12, wherein said constituent gases are hydrogen and oxygen.

14. Apparatus for accelerating a projectile comprising:

a launch tube having an inlet end and a muzzle end;

a projectile disposed within said launch tube, said projectile and launch tube forming a ramjet;

a combustible gaseous mixture contained within said launch tube, said combustible gaseous mixture varying in composition and density in a predetermined manner from the inlet end to the muzzle end of said launch tube to increase the speed of sound in a predetermined manner from the inlet end to the muzzle end so that, as said projectile accelerates through said launch tube, the Mach number of said projectile is maintained within a predetermined range; and means for igniting said combustible gaseous mixture.

* * * * *

UNITED STATES PATENT AND TRADEMARK OFFICE

CERTIFICATE OF CORRECTION

PATENT NO. : 4,938,112

DATED : July 3, 1990

INVENTOR(S) : Hertzberg et al.

It is certified that error appears in the above-identified patent and that said Letters Patent is hereby corrected as shown below:

| | |
|---|---|
| Column 2, line 38 | "throad" should be --throat-- |
| Column 4, line 37 | "KEYLAR" should be --KEVLAR-- |
| Column 11, line 8 | "as" should be --was-- |
| Column 12, line 30 | "gum" (first occurrence) should be --gun-- |
| Column 12, line 30 | "gum" (second occurrence) should be --gun-- |
| Column 12, line 33 | after "wherein" delete "the" |
| Column 12, line 60 | after "number" insert --range-- |
| Column 13, line 65 | "FIG.4" should be --FIGURE 14-- |
| Column 15, line 67 | "meas" should be --means-- |
| Section [56], Other Publications, "Exhibit A...," line 2 | "the" should be --to-- |

Signed and Sealed this

Sixteenth Day of June, 1992

*Attest:*

*Attesting Officer*

DOUGLAS B. COMER

*Acting Commissioner of Patents and Trademarks*